United States Patent [19]

Li

[11] Patent Number: 4,700,860

[45] Date of Patent: Oct. 20, 1987

[54] TAMPER INDICATING VACUUM PACKAGE

[75] Inventor: Ernest L. Li, Toledo, Ohio

[73] Assignee: Owens-Illinois, Inc., Toledo, Ohio

[21] Appl. No.: 846,447

[22] Filed: Mar. 31, 1986

[51] Int. Cl.[4] ..... B65D 41/48

[52] U.S. Cl. ..... 215/256; 215/341; 215/317; 215/253

[58] Field of Search ..... 215/253, 256, 317, 341

[56] References Cited

U.S. PATENT DOCUMENTS

| | | | |
|---|---|---|---|
| 3,071,275 | 1/1963 | Foss et al. | 215/317 |
| 4,527,705 | 7/1985 | Prades | 215/341 |
| 4,593,830 | 6/1986 | Bullock | 215/256 |

*Primary Examiner*—George T. Hall
*Attorney, Agent, or Firm*—H. G. Bruss

[57] ABSTRACT

A tamper indicating hermetically sealed package comprising a container having a neck with an opening and a closure. The container includes a first annular bead at the upper end adjacent the opening and a second annular bead spaced axially from the first annular bead and having a greater diameter than the first bead. The closure is made of plastic and comprises a base wall and a peripheral skirt. The base wall includes an annular bead on the internal surface thereof and the peripheral skirt includes an interrupted annular bead spaced axially from the base wall. A sealing gasket is cast in situ in the channel defined by the annular bead on the base wall and the peripheral skirt and extends to the interrupted annular bead on the skirt. A tamper indicating band is connected along a weakened line to the peripheral skirt and includes an interrupted annular bead that is adapted to engage the second bead on the container.

2 Claims, 4 Drawing Figures

TAMPER INDICATING VACUUM PACKAGE

This invention relates to packages for containing products under vacuum.

BACKGROUND AND SUMMARY OF THE INVENTION

In packaging certain products such as baby foods and juices, it is common to provide a hermetically sealed vacuum package that comprises a closure and a container wherein the closure is forced axially onto the container and has a sealing gasket cast in situ that engages the finish of the container to provide a seal. Typically, the closure is made of metal and the container is made of glass. It is also common that the container have an interrupted thread on its finish which becomes embedded in the gasket material to form a thread so that the closure can be removed by an unthreading action. The provision of such a thread produces problems in production and requires careful monitoring and inspection of the containers. In addition, the rolled edge of the metal cap can cause rusting if not properly formed. The gasket material needs to be distributed over a large area and with a greater thickness to provide a thread in the gasket material.

Among the objectives of the present invention are to provide a hermetically sealed package wherein the closure is made of plastic; which requires a much less complex finish on the container; wherein the closure design minimizes the number of internal contours; wherein the design results in a controlled flow of sealing gasket material during manufacture; wherein the closure can be applied by a relative vertical motion between the closure and the container and wherein the closure can be readily resealed on the container. A further objective is to provide such a package embodying a tamper indicating band.

In accordance with the invention, the tamper indicating hermetically sealed package comprises a container having a neck with an opening and a closure. The container includes a first annular bead at the upper end adjacent the opening and a second axially annular bead spaced axially from the first bead and having a greater diameter than the first bead. The closure is made of plastic and comprises a base wall and a peripheral skirt. The base wall includes an annular bead on the internal surface thereof and the peripheral skirt includes an interrupted annular bead spaced axially from the base wall. A sealing gasket is cast in situ in the channel defined by the annular bead on the base wall and the peripheral skirt and extends to the interrupted annular bead on the skirt. A tamper indicating band is connected along a weakened line to the peripheral skirt and includes an interrupted annular bead that is adapted to engage the second bead on the container.

DESCRIPTION

Figure 1:
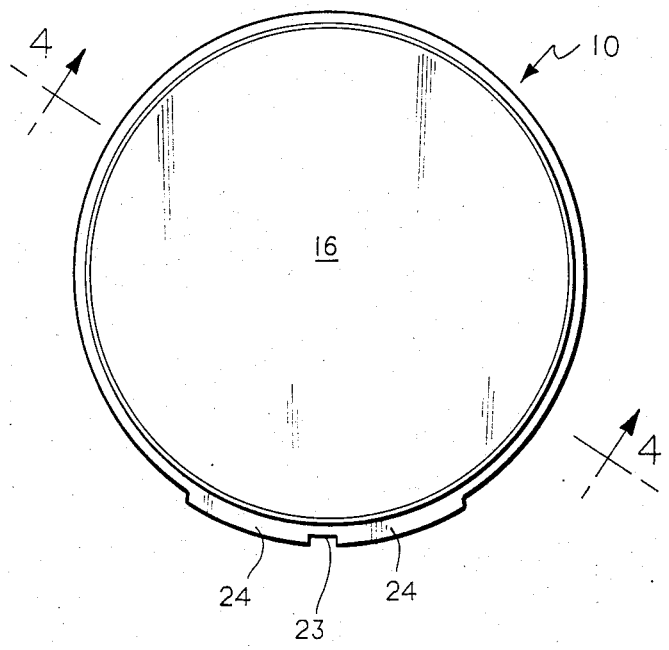
FIG. 1 is a plan view of a closure embodying the invention.

Referring to the drawings, the hermetically sealed package embodying the invention comprises a plastic closure 10 and a container 11 preferably made of glass. The container 11 includes a neck 12 having a finish including a flat top surface 13, a first annular bead 14 merging with the top surface 13 and a second annular bead 15 spaced axially from the bead 14 and having a greater diameter than the bead 14.

The closure 10 comprises a base wall 16 and a peripheral skirt 17. The base wall 16 includes a downwardly extending annular bead 18. The skirt 17 includes an interrupted segmental annular bead 19 which is adapted to snap over the bead 14 of the container. The closure further includes a tamper indicating band 20 connected to the lower edge of the skirt 17 by a weakened line 21 defined by a thin portion. The tamper indicating band 20 includes an annular segmental bead 22 that is adapted to snap over the second bead 15 of the container. The tamper indicating band 20 further includes a vertically weakened portion 23 and thickened portions 24, the latter being adapted to be grasped for tearing along the portion 23 so that the tamper indicating band can be broken away permitting the closure to be removed by prying action.

Figure 2:
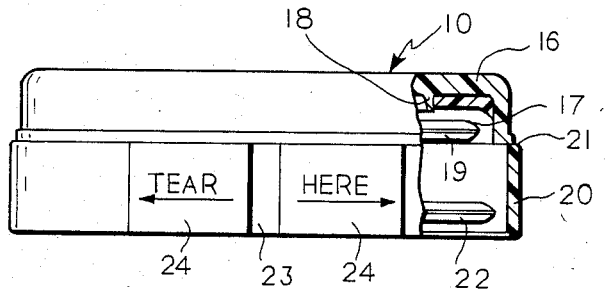
FIG. 2 is a part sectional elevational view of the closure.
Figure 3:
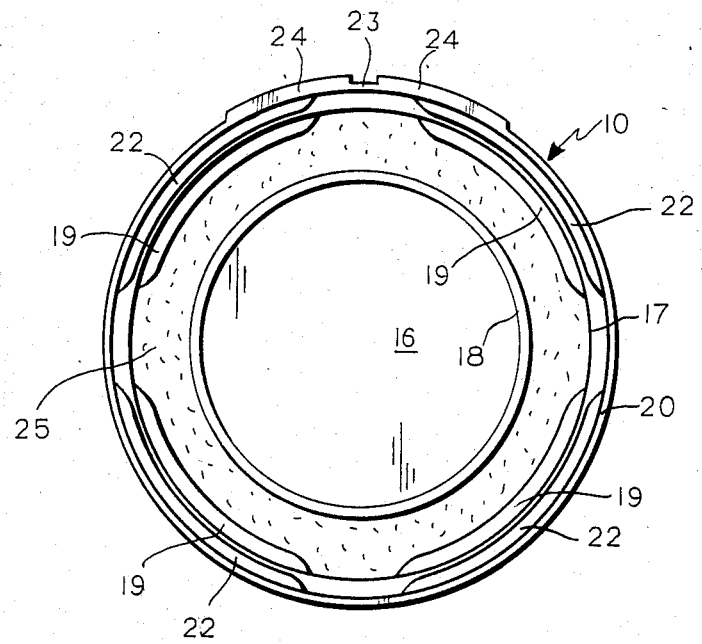
FIG. 3 is a bottom plan view of the closure.

The closure 10 further includes a sealing gasket 25 that is cast in situ in the groove defined by the annular bead 18 on the inner surface of the base wall 16 and peripheral skirt 17. The material of the gasket is, for example, a plastisol which is cured after being cast in place. During the application of the liquid plastisol to the closure, the bead 19 on the skirt 17 functions to limit the flow of the gasket material so that the resultant gasket has a portion extending along the skirt 17 to the bead 19 as shown in FIG. 2.

Figure 4:
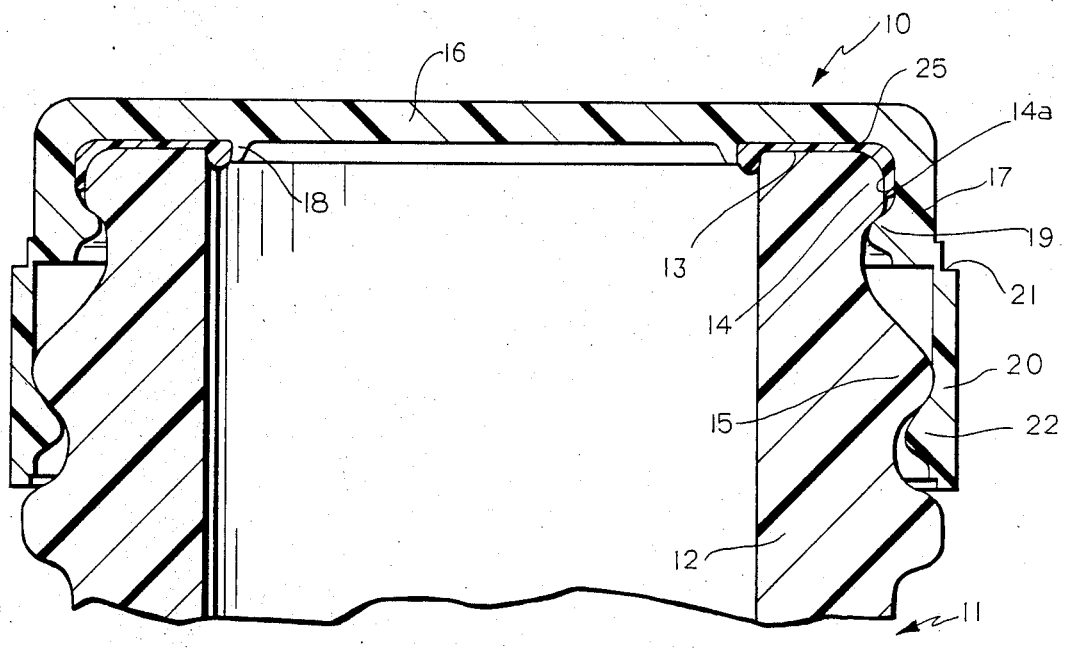
FIG. 4 is a sectional view of the package taken along the line 4—4 in FIG. 1.

In use, the contents of the container are placed in the containers and are usually hot. The closure 10 is then forced axially onto the container 11, the bead 22 snapping over the bead 15 and the bead 19 of the closure snapping over the bead 14 of the container 11. The force resulting from the engagement of the bead 19 over the bead 14 displaces or deforms the gasket 25 to the configuration as shown in FIG. 4 wherein the surface 13 and vertical or side portion 14a of bead 14 are in contact with the sealing gasket 25.

When it is desired to use the contents, the tear indicating band 20 is severed at the weakened line 23 and pulled to remove it by severing along the line 21. The closure can thereafter be pried off the container. After some of the contents are dispensed, the closure can be placed back on the container by an axial downward force causing the bead 19 of the closure to snap over the bead 14 of the container resealing the content.

It can thus be seen that the hermetically sealed package embodying the invention utilizes a closure made of plastic obviating the problems of metal closure, utilizes less gasket material, is easier to apply and includes a tamper indicating band. The provision of interrupted beads on the closure facilitates both manufacture and application to the container.

I claim:

1. A hermetically sealed package comprising a container having a neck with an opening and a closure, said neck having a top surface and a side surface, said container including a first annular bead at the upper end adjacent the opening and a second annular bead spaced axially below the first bead and having a greater diameter than the first bead on the container, said closure being made of plastic and comprising a base wall and a peripheral skirt, said base wall including an annular bead on the internal surface thereof, said peripheral skirt including an interrupted first annular bead on the internal surface thereof spaced axially from said base wall and engaging said first annular bead on the container, said first annular bead on said base wall and said bead on said peripheral skirt defining an annular channel having a portion along the inner surface of said base wall and a portion along the inner surface of said peripheral skirt, a sealing gasket being cast in situ in the portions of the channel defined by the first annular bead on said base wall and the first bead said peripheral skirt and extending axially along the inner surface of said peripheral skirt to the interrupted first annular bead on said skirt such that when the annular bead on the closure engages the first annular bead on the container, it causes the sealing gasket to deform such that the top surface and side surface of the neck of the container are sealed against the gasket, a tamper indicating band connected along a weakened line to the peripheral skirt and including a second interrupted annular bead on said band spaced from said weakened line engaging and having a greater diameter than the first interrupted bead on said skirt and engaging said second bead on the container.

2. A closure for a vacuum package comprising a container having a neck with an opening and a closure, said closure being made of plastic and comprising a base wall and a peripheral skirt, said base wall including an annular bead on the internal surface thereof, said peripheral skirt including an interrupted first annular bead on the internal surface thereof spaced axially from said base wall adapted to engage an annular bead on a container and engaging said first annular bead on the container, said annular bead on said base wall and said peripheral skirt defining an annular channel having a portion along the inner surface of said base wall and a portion along the inner surface of said peripheral skirt, a sealing gasket being cast in situ in the portions of the channel defined by the annular bead on said base wall and said peripheral skirt and extending axially along the inner surface of said peripheral skirt to the interrupted annular bead on said skirt such that when the annular bead on a closure is snapped over and engages the first annular bead on the container, it causes the sealing gasket to deform such that the top surface and side surface of the neck of the container are sealed against the gasket, said first bead projecting radially inwardly toward the center of the closure a greater distance than the second bead, a tamper indicating band connected along a weakened line to the peripheral skirt and including second interrupted annular bead on said band spaced from said weakened line engaging and having a greater diameter than the interrupted bead on said skirt and engaging a second annular bead on the container.

* * * * *